US006733653B2

(12) United States Patent
Jangbarwala

(10) Patent No.: US 6,733,653 B2
(45) Date of Patent: May 11, 2004

(54) ELECTROWINNING CELL INCORPORATING METAL ION FILTRATION APPARATUS

(75) Inventor: Juzer Jangbarwala, Chino Hill, CA (US)

(73) Assignee: Hydromatix, Inc., Santa Fe Springs, CA (US)

( * ) Notice: Subject to any disclaimer, the term of this patent is extended or adjusted under 35 U.S.C. 154(b) by 89 days.

(21) Appl. No.: 09/916,062

(22) Filed: Jul. 26, 2001

(65) Prior Publication Data

US 2003/0057103 A1 Mar. 27, 2003

Related U.S. Application Data

(63) Continuation of application No. 09/322,745, filed on May 28, 1999, now abandoned.

(51) Int. Cl.[7] ..... C25D 17/00; C25C 1/00

(52) U.S. Cl. ..... 205/687; 204/212; 204/238; 204/240; 204/273; 204/275.1; 204/276; 205/560

(58) Field of Search ..... 204/235, 238, 204/240, 273, 275.1, 212; 205/560

(56) References Cited

U.S. PATENT DOCUMENTS

| | | | | |
|---|---|---|---|---|
| 4,212,722 A | | 7/1980 | Avedesian et al. | |
| 4,431,496 A | | 2/1984 | Remick | |
| 4,960,584 A | | 10/1990 | Brown | |
| 5,116,511 A | | 5/1992 | Green et al. | |
| 5,149,411 A | | 9/1992 | Castle | |
| 5,183,544 A | | 2/1993 | Weber et al. | |
| 5,310,486 A | | 5/1994 | Green et al. | |
| 5,476,591 A | | 12/1995 | Green | |
| 5,733,431 A | * | 3/1998 | Green et al. | 205/581 |
| 6,156,186 A | | 12/2000 | Mueller et al. | |
| 6,165,344 A | * | 12/2000 | Green et al. | 205/581 |
| 6,355,175 B1 | * | 3/2002 | Green et al. | 210/652 |

FOREIGN PATENT DOCUMENTS

WO WO 00/73539 A1 12/2000

OTHER PUBLICATIONS

Undated brochure entitled "Acid Metals Water" by Desal Membrane Products.

* cited by examiner

*Primary Examiner*—Donald R. Valentine
(74) *Attorney, Agent, or Firm*—Timothy J. Martin; Michael R. Henson; Rebecca A. Gegick

(57) ABSTRACT

The present invention relates to an electrowinning cell adapted to recover metal ions from a solution as their corresponding elementary metals. The electrowinning cell includes a reservoir and a filter in fluid communication with the reservoir. The filter is operative to receive a solution containing metal ions from a location proximate to the cathode and to retain a first portion of the solution having a first concentration of metal ions and to remove a second portion of the solution having a second concentration of metal ions lower than the first concentration. The electrowinning cell additionally includes return means operative to return the first portion of the solution to the reservoir. The present invention also relates to a method of concentrating metal ions in a solution for use in an electrochemical cell and to a system for reducing metal ions in a solution to their corresponding elementary metals.

33 Claims, 4 Drawing Sheets

ELECTROWINNING CELL INCORPORATING METAL ION FILTRATION APPARATUS

CROSS-REFERENCE TO RELATED APPLICATIONS

This application is a continuation of application Ser. No. 09/322,745, filed May 28, 1999, now abandoned, entitled "Electrowinning Cell Incorporating Metal Ion Filtration Apparatus."

FIELD OF THE INVENTION

The present invention broadly relates to the recovery of metal ions from ionic solutions. More specifically, the present invention relates to electrowinning cells for use in recovering metal ions from aqueous solutions as elementary metals. In particular, the present invention is directed to an improved electrowinning system, method and apparatus.

BACKGROUND OF THE INVENTION

Electrowinning cells are mechanisms used extensively for recovering metal ions from solutions as elementary metals. Such cells may be used, for example, in the recovery and purification of copper. The mechanism generally consists of a collection tank, an anode, a cathode and a direct current (DC) power source. The metals gain electrons, achieve a valence of zero and deposit on the cathode.

The efficiency of an electrowinning cell is directly proportional to the concentration of the metal ions in the immediate vicinity of the cathode. As metal ions deposit on the cathode as their elementary metals during the electrowinning process, however, the concentration of metal ions in the vicinity of the cathode decreases, thereby reducing the efficiency of the cell.

In order to improve the efficiency of an electrowinning cell, it is known to constantly agitate or move the ionic solutions by various mechanisms, such as by the use of fluidized beds of glass beads, rotating cathodes, and other means. These mechanisms, however, cannot significantly increase efficiency in the later stage of electrowinning when most of the metal has been recovered on the cathode and the concentration of metal ions in the solution is much lower than optimum levels.

Accordingly, this dilute solution is typically discharged from the cell and the metal ions are treated with secondary methods to concentrate the metal ions in solution again. One such method is to adjust the pH of the solution to between 4 and 6, and treat the water with a chelating type of ion exchange resin. The regenerant from the resin is then sent back to the electrowinning cell. Such a method of concentrating requires decanting the cell, adding chemicals for pH adjustment, and regenerating the solution from the ion exchange resin. The use of such secondary methods of concentration interrupts the electrowinning process and impacts the overall efficiency of the cell.

Accordingly, there remains a need to provide a new and improved electrowinning cell apparatus and system and a new and improved method of concentrating an ionic solution for use with an electrowinning cell. The present invention is directed to meeting these needs.

SUMMARY OF THE INVENTION

It is an object of the present invention to provide an efficient electrowinning cell adapted to recover metal ions from a solution.

It is another object to provide a cost effective and efficient method of concentrating metal ions in a solution for use in an electrochemical cell.

It is yet another object to provide a method and apparatus for improving the efficiency of an electrowinning cell which avoids interrupting the electrochemical process.

It is still a further object to provide an electrowinning cell which improves the efficiency of standard electrowinning cells in the later stages of electrowinning.

It is yet another object to provide a new and improved system for reducing metal ions in a solution to their corresponding elementary metals.

Yet another object is to provide an efficient and integrated electrowinning cell system.

A still further object is to provide an improvement to an electrowinning cell which circumvents the necessity for performing traditional secondary methods of concentrating metal ions in an electrowinning solution.

According to the present invention, an electrowinning cell is provided which is adapted to recover metal ions from a solution as their corresponding elementary metals. The electrowinning cell comprises a reservoir adapted to receive a solution containing metal ions at a selected concentration, an anode and a cathode disposed in the reservoir, a filter in fluid communication with the reservoir and operative to receive the solution from a location proximate to the cathode, and a return means operative to return the first portion of the solution to the reservoir. The anode and cathode are operative to establish an electric potential difference therebetween. The filter is operative to retain a first portion of the solution having a first concentration of metal ions and to remove a second portion of the solution having a second concentration of metal ions lower than the first concentration, thereby to improve the concentration of metal ions in the solution and consequently increase the efficiency of the electrowinning cell. The filter according to the present invention is preferably a nanofilter, and more preferably a nanofilter of the crossflow membrane type.

It is preferred that the electrowinning cell according to the present invention includes a solution holding tank in fluid communication with the reservoir and the filter. A filter collection tank is also preferred, where the filter collection tank is in fluid communication with the solution holding tank and the filter. A microfilter may be disposed between the nanofilter and the filter collection tank, in order to filter out undesired particles and the like which may otherwise obstruct the nanofilter. The electrowinning cell also preferably includes an electrowinning collection tank in fluid communication with the solution holding tank and the reservoir. At least one pump may be provided to circulate the solution between the components of the apparatus.

A flow-rate sensor and a valve in fluid communication with the solution may be provided. The valve has a first state allowing fluid flow and a second state preventing fluid flow. A microprocessor control may further be provided which is operative to receive data from the flow-rate sensor and to adjust the flow-rate of the solution by moving the valve between the first and second states.

The present invention is also directed to a method of concentrating metal ions in a solution for use in an electrochemical cell. The method comprises the steps of drawing a portion of a solution containing metal ions from a region proximate to a cathode in an electrochemical cell, filtering the portion of the solution thereby to create a retentate having a first concentration of metal ions and a permeate having a second concentration of metal ions lower than the first concentration, and returning the retentate to the electrochemical cell.

A system for reducing metal ions in a solution to their corresponding elementary metals is also provided. The system comprises a fluid source operative to provide a solution containing metal ions at a selected concentration, a reservoir in fluid communication with the fluid source and operative to receive the solution, an anode and a cathode each disposed in the reservoir, and a power source operative to supply electric current to the anode and the cathode. A filter in fluid communication with the reservoir includes a membrane, wherein the filter has a first region on one side of the membrane and a second region on an opposite side of the membrane. A retentate of the solution is disposed in the first region of the filter, and a permeate of the solution is disposed in the second region of the filter. The retentate has a first concentration of metal ions and the permeate has a second concentration of metal ions lower than the first concentration. A return means is operative to return the retentate to the reservoir.

The present invention also provides an improvement to an electrowinning cell operative to reduce metal ions at a selected concentration in a solution at a location proximate to a cathode in a reservoir to their corresponding elementary metals. The improvement comprises a filter apparatus in fluid communication with the reservoir and operative to draw the solution from a region proximate to the cathode and to filter the solution into a first portion having a first concentration of metal ions greater than the selected concentration and a second portion having a second concentration of metal ions lower than the selected concentration. The filter apparatus is further operative to return the first portion to the reservoir. The filter apparatus may include a filter, a valve, a conduit and a pump, and the filter may include a membrane filter of the nanofiltration range.

These and other objects of the present invention will become more readily appreciated and understood from a consideration of the following detailed description of the exemplary embodiment of the present invention when taken together with the accompanying drawings, in which:

DETAILED DESCRIPTION OF THE EXEMPLARY EMBODIMENTS

The present invention generally concerns a new and efficient electrowinning cell for use in recovering metal ions from an ionic solution. In particular, the present invention incorporates a filter operative to retain a first component of the solution that contains a high concentration of metal ions while removing a second component of the solution that contains a low concentration of metal ions. This process operates to improve the concentration of metal ions in the ionic solution, thereby to increase the overall efficiency of the cell. In operation, a portion of the ionic solution is drawn from a reservoir in a region proximate to a cathode wherein an electrowinning process has reduced the concentration of metal ions in the solution. This portion of the solution is passed through the filter, whereby metal ions are retained in a retentate which is then returned to the reservoir. The permeate portion of the solution which passes through the filter and which contains a minimal concentration of metal ions is sent to waste, wherein any remaining metal ions may be recovered, if desired, by additional processes such as by further filtration or by secondary methods known in the art.

Figure 1:
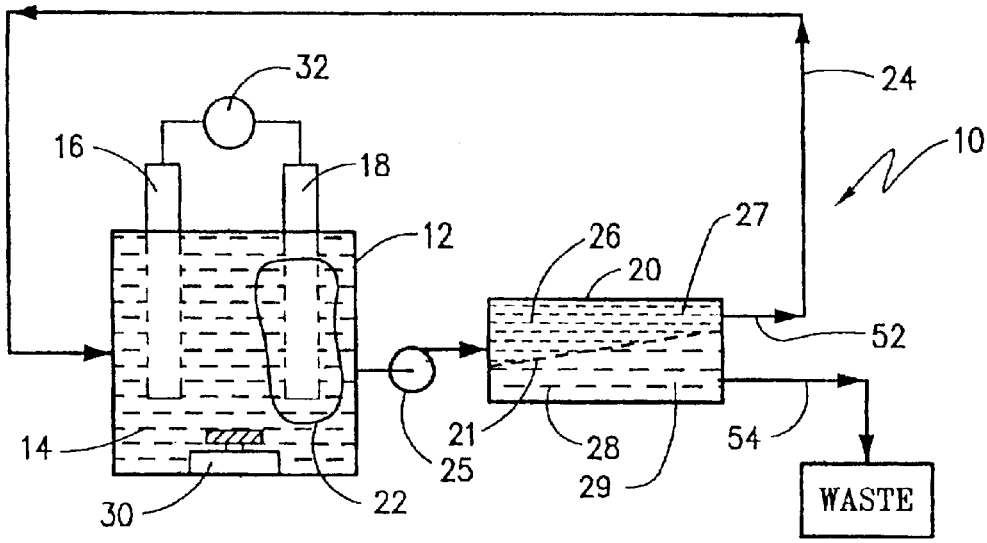
FIG. 1 is a diagrammatic view of a first embodiment of the electrowinning cell according to the present invention.

Accordingly, as is shown in FIG. 1, a first embodiment of the electrowinning cell 10 includes a reservoir 12 which is adapted to receive an ionic solution 14. Ionic solution 14 contains metal ions, such as divalent copper ions in the case of a solution containing $CuSO_4$, at a selected concentration. Reservoir 12 includes an anode 16 and a cathode 18 disposed therein. Together, reservoir 12, solution 14, anode 16 and cathode 18 form an electrochemical cell, as is known in the art. Anode 16 and cathode 18 are operative to establish an electric potential difference therebetween. This potential difference preferably is established by operation of an electrical power source 32 which is operative to supply a voltage differential to the anode 16 and the cathode 18, as is commonly known for use in electrolytic cells in the art. It should be appreciated, however, that the electric potential difference may be established by constructing the electrochemical cell as a galvanic cell as is also known in the art.

During operation of the electrowinning cell 10, metal ions in solution 14 electroplate onto cathode 18. Correspondingly, the concentration of metal ions in solution 14 at a location 22 proximate the cathode 18 decreases as metal ions are reduced to their corresponding elementary metals. Agitator 30, which is preferably disposed in reservoir 12, is provided to distribute metal ions in solution 14 more uniformly throughout reservoir 12, and in particular to agitate the solution at the location 22 proximate the cathode 18. Agitator 30 may take the form of a mixer, blender, or other means of agitating a solution, as is known in the art. Preferably, agitator 30 includes a bed of fluidized glass beads to assist fluid distribution. Alternatively, agitator 30 may be comprised of a motor operative to rotate cathode 18 about a longitudinal axis thereof, thereby to agitate solution 14 in the location 22 proximate to cathode 18.

Filter 20, which is preferably a crossflow membrane filter of the nanofiltration range, is in fluid communication with the reservoir and receives solution 14 from the location 22 proximate to the cathode 18. Pump 25 in fluid communication with the filter 20 and the reservoir 12 may provide solution 14 to filter 20 at a selected fluid pressure. Alternatively, filter 20 may receive solution 14 by gravity flow or other means known in the art for transporting fluid.

The filter 20 is operative to filter solution 14 into a retentate 52 and a permeate 54. Retentate 52 is formed as a first portion 26 of the solution 14 which remains in a first region 27 and does not pass through the membrane 21 of filter 20. First portion 26 has a first concentration of metal ions. Permeate 54 is formed as a second portion 28 of the solution 14 which passes through the membrane 21 of filter 20 to a second region 29 on the opposite side of membrane 21 from first region 27. Permeate 54 has a second concentration of metal ions which is lower than the first concentration of metal ions in the first portion 26. It should be understood that the filter 20 may be highly efficient at filtering out metal ions whereby the concentration of metal ions in the permeate may be zero or about zero and all or nearly all of the metal ions in solution 14 are retained in the retentate 52. It is contemplated, however, that minor imperfections in filter 20 will allow some metal ions to permeate therethrough. Alternatively, filter 20 may comprise a plurality of less efficient filters that may be used in a multistage series, whereby metal ions remaining in the permeate from each stage are further concentrated by the next filter in the series. In either case, permeate 54 may be sent to waste or, if desired, may be further filtered or treated with secondary concentration methods known in the art in order to recover any metal ions contained in permeate 54.

Retentate 52 is returned to the reservoir 12 by a return means, preferably a conduit 24 in fluid communication with filter 20 and reservoir 12. Retentate 52 may be returned by operation of a pump, such as pump 25, or by gravity flow or other means known in the art. It should be understood that any return means known in the art for transporting solution may be utilized, including manual transport by container, drip valve, gravity flow, conduit, or other means. By returning retentate 52 to reservoir 12 to intermix with solution 14, the concentration of metal ions in solution 14 is improved. This improvement in the concentration of metal ions in solution 14 increases the efficiency of the electrochemical cell.

Figure 2:
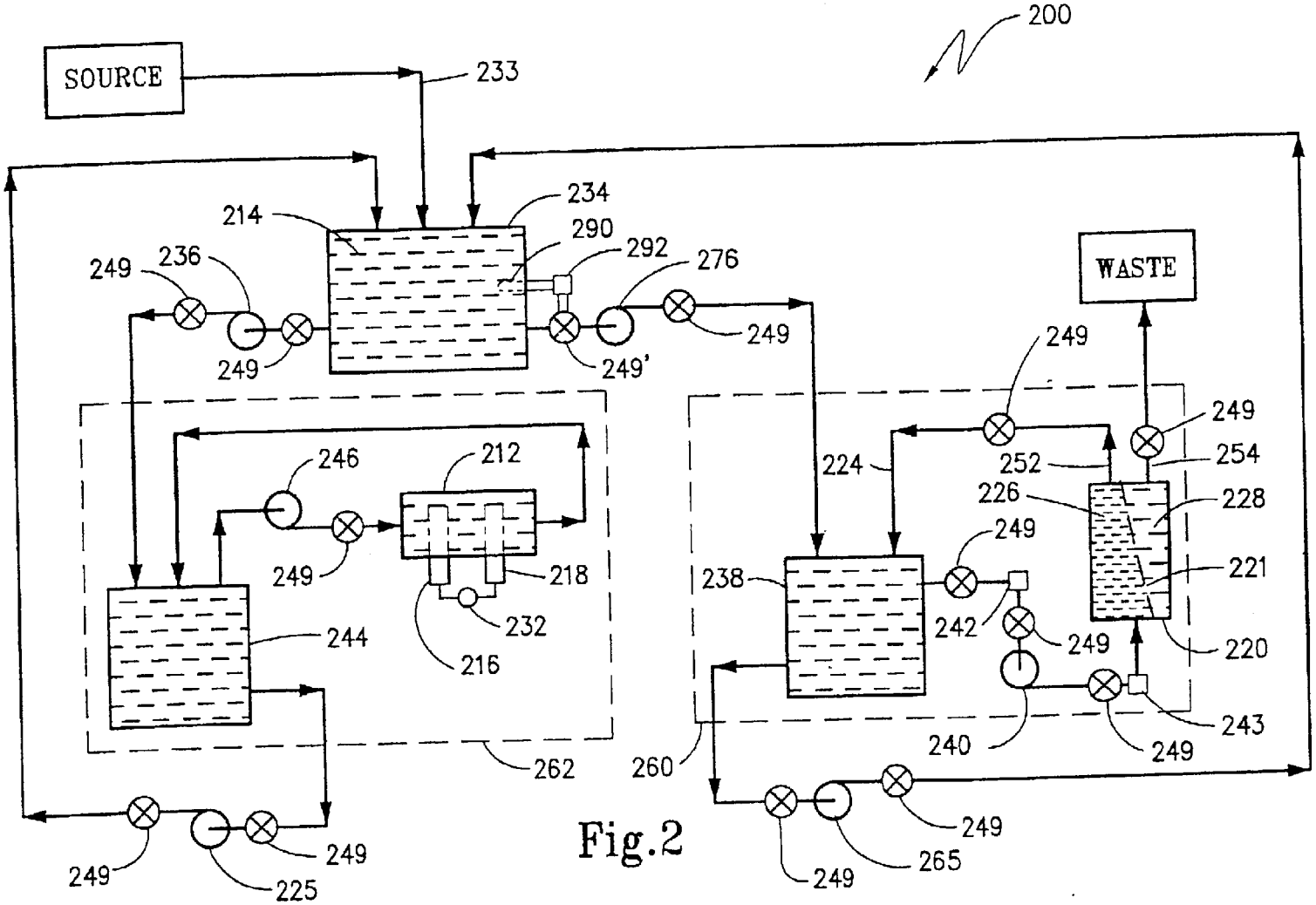
FIG. 2 is a diagrammatic view of a second embodiment of the electrowinning cell according to the present invention.

A second embodiment of the present invention is illustrated with respect to FIG. 2. In this embodiment, electrowinning system 200 comprises a fluid source 233 operative to supply a solution 214 containing metal ions at a selected concentration to a solution holding tank 234. The electrowinning system 200 forms a pair of closed circulation loops: an electrowinning loop including an electrowinning apparatus 262, and a filtration loop including a filtration apparatus 260. Both loops circulate in fluid communication with the solution holding tank 234.

Looking first to the electrowinning loop, the electrowinning collection tank 244 is in fluid communication with the solution holding tank 234 and with an electrochemical cell similar to that described with reference to FIG. 1, including a reservoir 212, a solution 214, an anode 216, a cathode 218 and a power supply 232 operative to supply a voltage differential to anode 216 and cathode 218. A pump 246 is operative to circulate solution 214 between electrowinning collection tank 244 and reservoir 212, although other circulation and/or agitation means are contemplated. Together, the electrochemical cell, the electrowinning collection tank 244, and the pump 246 make up an electrowinning apparatus 262. Valves 249 may additionally be included in electrowinning apparatus 262 to control the flow of solution 214 as desired. Pumps 225 and 236 in fluid communication with the solution holding tank 234 and the electrowinning collection tank 244 are further operative to circulate solution 214 therebetween.

Looking next to the filtration loop, the filter collection tank 238 is in fluid communication with the solution holding tank 234 and with a filter 220 operative to retain the metal ions in solution 214. Preferably, solution holding tank 234 includes a concentration sensor 290 and a controller 292 in communication with valve 249'. Concentration sensor 290 and controller 292 together are operative to monitor the concentration of metal ions in solution 214 in solution holding tank 234 and to operate valve 249 between a first and second state when the concentration of metal ions in solution 214 is below or above a selected concentration, respectively. The selected concentration corresponds to a concentration above which filter apparatus 260 does not perform optimally. In particular, it is preferred that valve 249' be moved into a first state allowing fluid flow to the filtration loop when the concentration of metal ions, such as divalent copper ions, is at or below 500 ppm (0.5 g/L $Cu^{2+}$). When the concentration of metal ions is above 500 ppm, it is preferred that valve 249' be moved into a second state preventing fluid flow to the filtration loop. Once the electrowinning process in the electrowinning loop has reduced the concentration of metal ions to a concentration within the optimal range for filter apparatus 260, valve 249' is again moved into the first state whereby solution 214 is concentrated by the filtration loop.

A pump 240 may be provided that is operative to provide solution 214 to filter 220 at a selected fluid pressure, preferably about 150 psi. In addition, microfilters 242 and 243 are disposed between filter collection tank 238 and filter 220 and are operative to remove particles which might otherwise clog filter 220. Preferably, microfilter 242 is a 5 micron filter and microfilter 243 is a 1 micron filter.

Filter 220 concentrates metal ions in solution 214 in a manner similar to that described with reference to filter 20 in FIG. 1. Filter 220 is operative to retain a first portion 226 of solution 214 and to allow a second portion 228 of solution 214 to permeate filter 220. First portion 226 contains a higher concentration of metal ions than does second portion 228, which may be sent to waste as permeate 254 or which may be treated with secondary methods of concentration as desired. Fluid source 233 may intermittently or constantly replenish the volume of solution 214 as permeate 254 is removed from the system. Preferably, solution 214 is provided by fluid source 233 in a volume and at a flow rate equal to the volume and flow rate at which permeate 254 is removed from the system.

First portion 226 is returned to filter collection tank 238 as retentate 252 by conduit 224. Together, filter collection tank 238, filter 220, conduit 224, and associated components such as pump 240, microfilters 242 and 243, comprise filter apparatus 260. Filter apparatus 260 may further include valves 249 or other means for controlling fluid flow as is known in the art. Pumps 265 and 276 are operative to further circulate solution 214 between filter apparatus 260 and solution holding tank 234, and ultimately between filter apparatus 260 and electrowinning apparatus 262. This arrangement allows for a highly efficient means of concentrating metal ions in solution 214 and for mixing and distributing solution 214 throughout the entire system, such as to the electrowinning apparatus 262 wherein the electrowinning process reduces metal ions to their corresponding elementary metals.

Figures 3, 4:
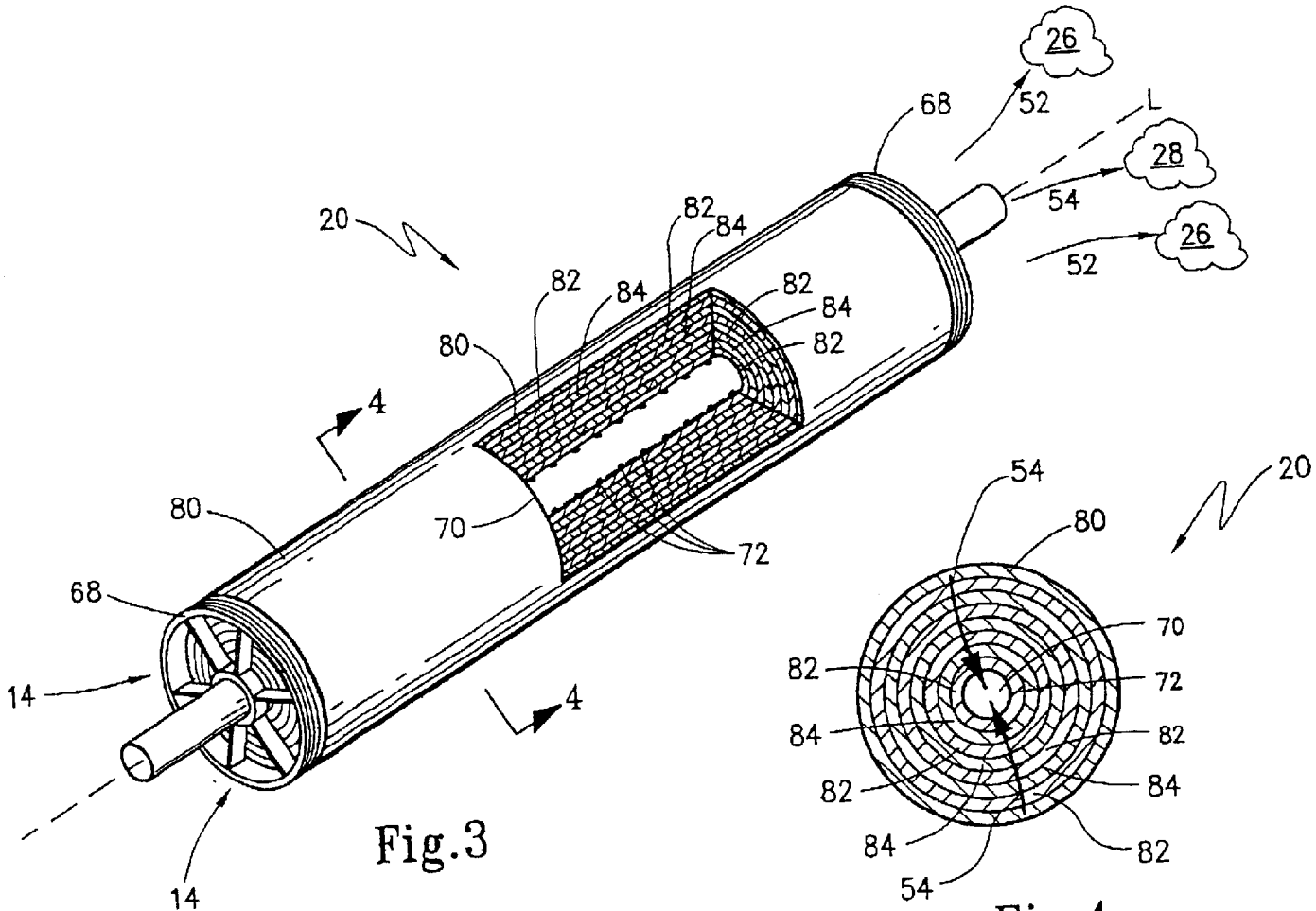
FIG. 3 is a perspective view in partial cross-section showing a filter for use in the electrowinning cell of the present invention, wherein a cross-sectional portion of the outerwrap, membrane layers and feed spacers has been removed.
FIG. 4 is a cross-sectional view about lines 4—4 of the filter in FIG. 3.
Figure 5:
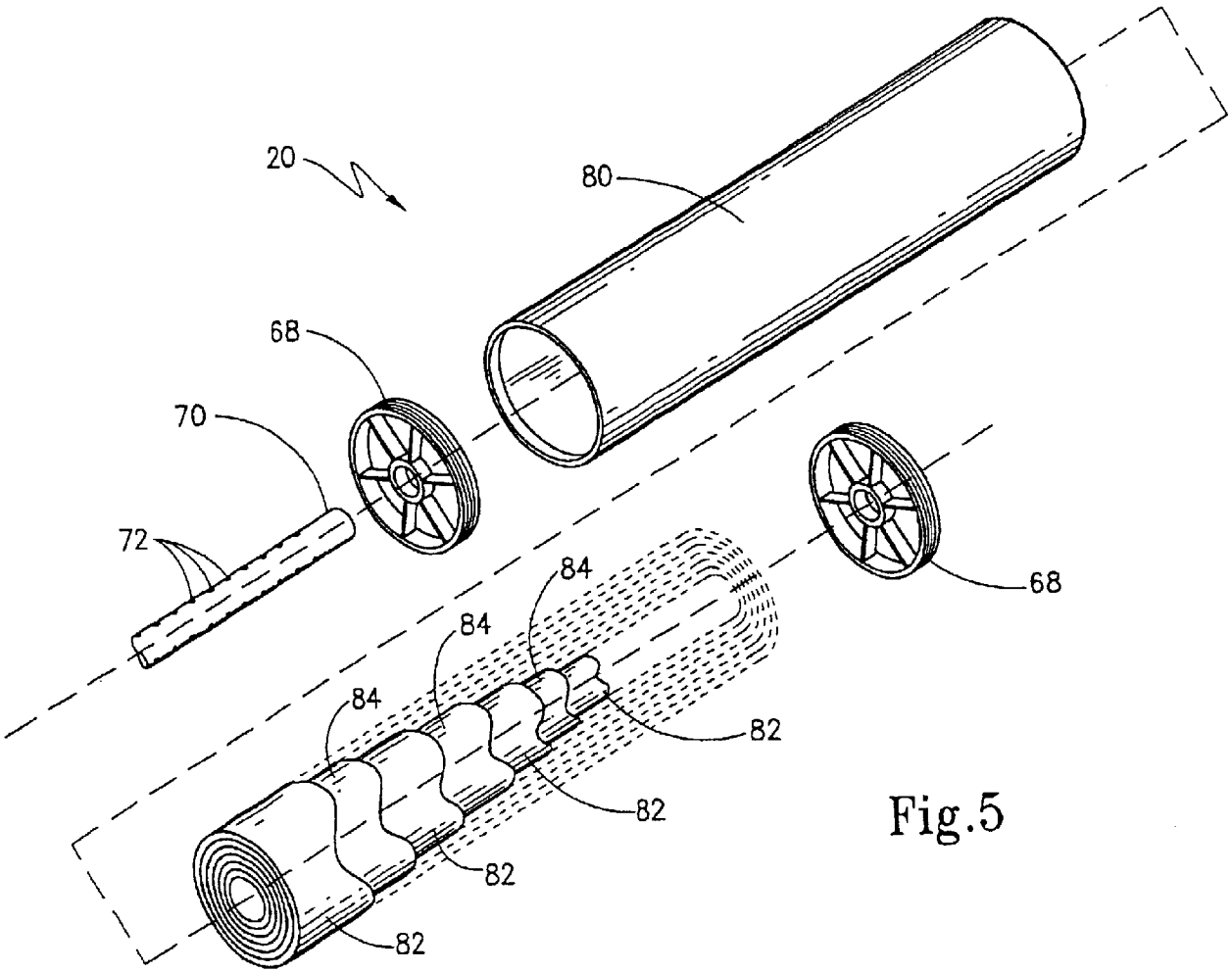
FIG. 5 is an exploded view in perspective of the filter in FIG. 3.

The filter 20 according to the present invention may be more fully understood with reference to FIGS. 3–5. Preferably, filter 20 is a nanofilter of the crossflow membrane variety. The preferred filter is a Desal™ proprietary membrane product manufactured by Osmonics, 760 Shadowridge Dr., Vista, Calif. 92083-7986. The Desal filter is a spiral wound module design incorporating a proprietary nanofiltration thin-film membrane (TFM®), designated the Desal-5™. This membrane preferentially rejects divalent and multivalent anions, while monovalent ion rejection is dependent upon feed concentration and composition. The membrane is characterized by a molecular weight cutoff of 150–300 daltons for uncharged organic molecules. Operating paramaters are as follows: operating pH of between 2.0–11.0 and cleaning pH of between 1.0–11.5; chlorine tolerance of 1,000 ppm-hours, such that dechlorination is recommended; maximum temperature is 122° F. (50° C.)

with standard element construction and up to 158° F. (70° C.) with special element construction; typical operating pressure is 70–400 psig (483–2,758 kPa) with a maximum pressure of 500 psig (3,448 kPa).

As shown in FIGS. 3–5, filter 20 includes a generally cylindrical outerwrap 80 which is preferably constructed of fiberglass. Outerwrap 80 surrounds membrane layers 82, also generally cylindrical, having a common central longitudinal axis L with outerwrap 80. Membrane layers 82 comprise cylinders of graduated radii which fit within outerwrap 80 in telescoping relation. Each of membrane layers 82 is separated from an adjacent membrane layer by feed spacers 84. Anti-telescoping devices 68 engage the ends of outerwrap 80 and membrane layers 82 thereby to prevent undesired telescoping extension of membrane layers 82 outside of outerwrap 80. Membrane layers 82 preferably further include a membrane, a membrane backing material, a carrier material, a feed channel spacer, and an outer layer spacer material. The membrane is preferably a nanofilter membrane operative to retain metal ions.

Filter 20 further includes a perforated central tube 70 having apertures 72 in a sidewall thereof. Perforated central tube 70 extends along longitudinal axis L and is surrounded by membrane layers 82 and feed spacers 84 in a spiral wound design.

The operation of filter 20 may be seen with reference to FIGS. 3 and 4. As shown in FIG. 3, solution 14 is passed through a first anti-telescoping device 68 and through membrane layers 82 and feed spacers 84. As shown in FIG. 4, permeate 54 permeates through membrane layers 82 and feed spacers 84 in a crossflow direction to arrive at perforated central tube 70, where permeate 54 enters perforated central tube 70 at apertures 72. Again with reference to FIG. 4, permeate 54 flows through perforated central tube 70 to be expelled from filter 20 as second portion 28. Retentate 52, which does not permeate membrane layers 82 and feed spacers 84 in a crossflow direction, is expelled from filter 20 through a second anti-telescoping device 68 as first portion 26 which has a higher concentration of metal ions than does second portion 28. It should further be appreciated that retentate 52 will have a higher concentration of metal ions than does solution 14, and that permeate 54 will have a lower concentration of metal ions than does solution 14.

Figure 6:
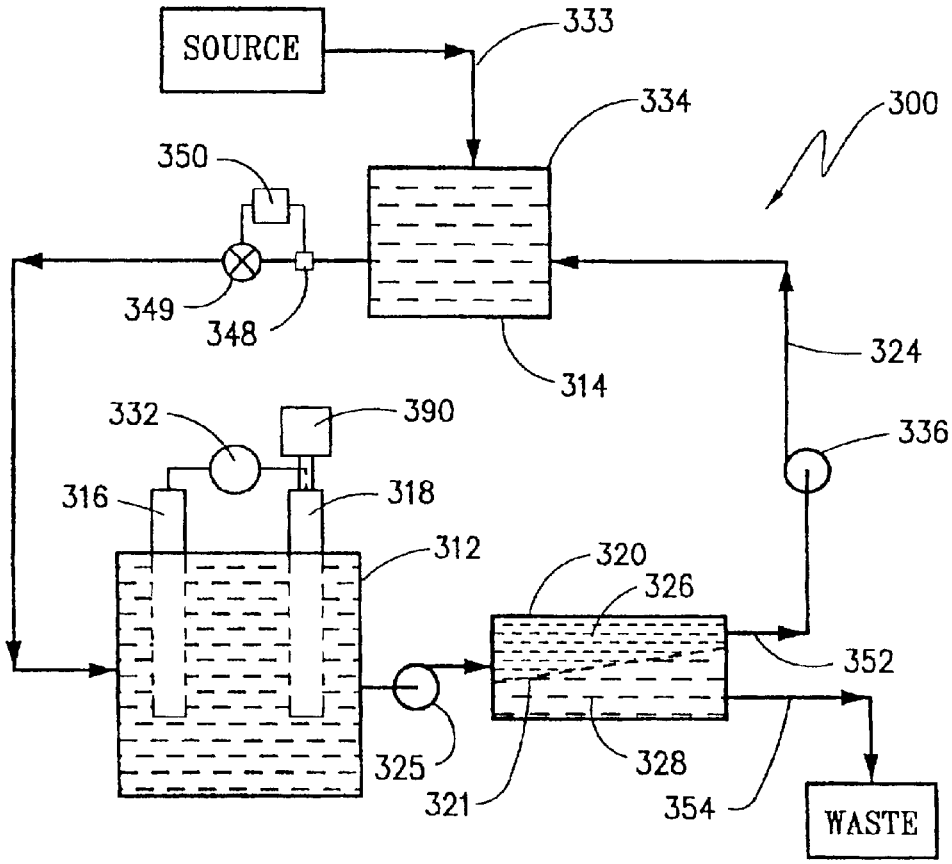
FIG. 6 is a diagrammatic view of a third embodiment of the present invention.

A third embodiment of the present invention is shown in FIG. 6. Electrowinning cell 300 includes a fluid source 333 which supplies solution 314 to solution holding tank 334. Solution holding tank 334 is in fluid communication with reservoir 312 and filter 320. Anode 316 and cathode 318 are disposed in reservoir 312. Motor 390 in mechanical communication with cathode 318 is operative to rotate cathode 318 about a longitudinal axis thereof. Electrical power supply 332 is operative to supply a voltage differential to anode 316 and cathode 318 and to establish an electrical potential difference therebetween. Pump 325 is operative to provide solution 314 to filter 320 at a selected fluid pressure.

Filter 320 is operative to filter solution 314 into a first portion 326 and a second portion 328 by allowing second portion 328 to permeate through membrane 321, as discussed above with respect to filters 20 and 220. Pump 336 is operative to return retentate 352 to solution holding tank 334 by conduit 324. Permeate 354 is sent to waste or treated by further filtration or secondary methods of concentration as desired. Solution holding tank 334 or reservoir 312 may further include apparatus for agitating solution 314 as discussed above.

Electrowinning cell 300 further includes a flow-rate sensor 348 and a valve 349 in fluid communication with solution 314. Valve 349 has a first state allowing fluid flow and a second state preventing fluid flow. Microprocessor control 350 which is in electrical communication with flow-rate sensor 348 and valve 349 is operative to receive data from flow-rate sensor 348 and to adjust the flow-rate of solution 314 by moving valve 349 between the first and second states.

It should be apparent from the foregoing that the present invention contemplates variations in the positioning of the reservoir, the filter, and any additional components chosen for inclusion in the electrowinning system, such as various tanks, pumps, valves, sensors, conduits, agitators, and the like.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

I claim:

1. An electrowinning cell adapted to recover metal ions from a solution as their corresponding elementary metals, comprising:

(a) a reservoir adapted to receive a solution containing metal ions at a selected concentration;

(b) an anode and a cathode disposed in said reservoir, said anode and cathode operative to establish an electric potential difference therebetween;

(c) a filter in fluid communication with said reservoir and operative to receive the solution from a location proximate to said cathode, wherein said filter is operative to retain a first portion of the solution having a first concentration of metal ions and to remove a second portion of the solution having a second concentration of metal ions lower than the first concentration; and (d) return means operative to return the first portion of the solution to said reservoir.

2. An electrowinning cell according to claim 1 including an agitator in fluid communication with said reservoir.

3. An electrowinning cell according to claim 2 wherein said agitator is disposed in said reservoir.

4. An electrowinning cell according to claim 2 wherein said agitator includes a fluidized bed of glass beads.

5. An electrowinning cell according to claim 2 wherein said agitator includes a motor which engages said cathode and is operative to rotate said cathode about a longitudinal axis thereof.

6. An electrowinning cell according to claim 1 including a power source in electrical communication with said anode and cathode and operative to supply a voltage differential to said anode and cathode.

7. An electrowinning cell according to claim 1 wherein said filter is a nanofilter.

8. An electrowinning cell according to claim 1 wherein said filter is a crossflow membrane filter.

9. An electrowinning cell according to claim 1 wherein the second concentration of metal ions is about zero.

10. An electrowinning cell according to claim 1 wherein said return means includes a conduit in fluid communication with said reservoir.

11. A method of concentrating metal ions in a solution for use in an electrochemical cell, comprising the steps of:

(a) drawing a portion of a solution containing metal ions from a region proximate to a cathode in an electrochemical cell;

(b) filtering the portion of the solution thereby to create a retentate having a first concentration of metal ions and a permeate having a second concentration of metal ions lower than the first concentration; and (c) returning said retentate to said electrochemical cell.

12. A method according to claim 11 wherein said electrochemical cell is an electrolytic cell.

13. A method according to claim 11 including the step of continuously providing the solution containing metal ions to the electrochemical cell from a fluid source and the step of continuously removing the permeate.

14. A method according to claim 11 wherein the step of is accomplished with a nanofilter operative to retain said metal ions.

15. A method according to claim 11 wherein the solution is agitated in the region proximate to said cathode.

16. A method according to claim 11 wherein said metal ions are divalent copper ions.

17. A system for reducing metal ions in a solution to their corresponding elementary metals, comprising:

(a) a fluid source operative to provide a solution containing metal ions at a selected concentration;

(b) a reservoir in fluid communication with said fluid source and operative to receive the solution;

(c) an anode disposed in said reservoir;

(d) a cathode disposed in said reservoir;

(e) a power source operative to supply electric current to said anode and said cathode;

(f) a filter in fluid communication with said reservoir and including a membrane, said filter having a first region on one side of said membrane and a second region on an opposite side of said membrane;

(g) a retentate of the solution disposed in the first region of the filter, said retentate having a first concentration of metal ions;

(h) a permeate of the solution disposed in the second region of the filter, said permeate having a second concentration of metal ions lower than the first concentration; and (i) a return means operative to return said retentate to said reservoir.

18. A system according to claim 17 wherein the solution is constantly drawn from a region proximate said cathode and provided to said filter.

19. A system according to claim 18 wherein said fluid source constantly provides the solution.

20. A system according to claim 17 wherein said filter is a crossflow membrane filter.

21. A system according to claim 17 wherein said membrane is a nanofilter membrane.

22. A system according to claim 17 including a pump in fluid communication with said filter and operative to provide the solution to said filter at a selected fluid pressure.

23. A system according to claim 17 wherein said retentate includes a first portion of the solution which does not pass through said membrane and wherein said permeate is formed by passing a second portion of the solution through said membrane.

24. A system according to claim 17 wherein gravity is operative to return said retentate to said reservoir.

25. In an electrowinning cell operative to reduce metal ions at a selected concentration in a solution at a location proximate to a cathode in a reservoir to their corresponding elementary metals, the improvement comprising a filter apparatus in fluid communication with said reservoir and operative to draw the solution from a region proximate to said cathode and to filter the solution into a first portion having a first concentration of metal ions greater than the selected concentration and a second portion having a second concentration of metal ions lower than the selected concentration, said filter apparatus further operative to return the first portion to said reservoir.

26. The improvement according to claim 25 wherein said filter apparatus includes a filter, a valve, a conduit and a pump.

27. The improvement according to claim 26 wherein said filter includes a membrane filter of the nanofiltration range.

28. An electrowinning cell adapted to recover metal ions from a solution as their corresponding elementary metals, comprising:

(a) a reservoir adapted to receive a solution containing metal ions at a selected concentration;

(b) an anode and a cathode disposed in said reservoir, said anode and cathode operative to establish an electric potential difference therebetween;

(c) a first conduit in fluid communication with said reservoir and having an inlet and an outlet, wherein said inlet of said first conduit is proximate to said cathode and is operative to receive the solution;

(d) a filter in fluid communication with said outlet of said first conduit and operative to receive the solution therefrom, wherein said filter is operative to retain a first portion of the solution having a first concentration of metal ions and to remove a second portion of the solution having a second concentration of metal ions lower than the first concentration; and (e) a second conduit in fluid communication with said filter and said reservoir, said second conduit including an inlet operative to receive said first portion of the solution from said filter and an outlet operative to return said first portion of the solution to said reservoir.

29. An electrowinning cell adapted to recover metal ions from a solution as their corresponding elementary metals, comprising:

(a) a solution holding tank adapted to receive a solution containing metal ions at a selected concentration from a fluid source;

(b) an electrowinning collection tank adapted to receive the solution;

(c) a first circulating conduit loop in fluid communication with said solution holding tank and said electrowinning collection tank and adapted to circulate the solution between said solution holding tank and said electrowinning collection tank;

(d) an electrowinning reservoir adapted to receive the solution;

(e) an anode and a cathode disposed in said electrowinning reservoir, said anode and cathode operative to establish an electric potential difference therebetween;

(f) a second circulating conduit loop in fluid communication with said solution holding tank and said electrowinning reservoir and adapted to circulate the solution between said solution holding tank and said electrowinning reservoir;

(g) a filter collection tank adapted to receive the solution;

(h) a third circulating conduit loop in fluid communication with said solution holding tank and said filter collection tank and adapted to circulate the solution between said solution holding tank and said filter collection tank;

(i) a nanofilter adapted to receive the solution and operative to concentrate metal ions in the solution thereby to form a retentate and a permeate, said retentate having a greater concentration of metal ions than said permeate; and (j) a fourth circulating conduit loop in fluid communication with said filter collection tank and said nanofilter and adapted to provide the solution from said filter collection tank to said nanofilter and to return said retentate from said nanofilter to said filter collection tank.

30. An electrowinning cell adapted to recover metal ions from a solution as their corresponding elementary metals, comprising:

(a) a reservoir adapted to receive a solution containing metal ions at a selected concentration;

(b) an anode and a cathode disposed in said reservoir, said anode and cathode operative to establish an electric potential difference therebetween;

(c) a filter in fluid communication with said reservoir and operative to receive the solution from a location proximate to said cathode, wherein said filter is operative to form a retentate having a first concentration of metal ions and to remove a permeate having a second concentration of metal ions lower than the first concentration;

(d) return means operative to return the first portion of the solution to said reservoir;

(e) a solution holding tank in fluid communication with said reservoir and said filter;

(f) a filter collection tank in fluid communication with said solution holding tank and said filter; and (g) a valve fluidly disposed between said solution holding tank and said filter collection tank and including a concentration sensor disposed in said solution holding tank and a controller in communication with said valve and said sensor, whereby said sensor and said controller are operative to monitor a concentration of metal ions in said solution holding tank and to move said valve between a first state allowing fluid flow to said filter collection tank when the concentration of metal ions is no greater than a selected concentration and to move said valve into a second state preventing fluid flow to said filter collection tank when the concentration of metal ions is greater than the selected concentration.

31. An electrowinning cell according to claim 30 wherein said filter is a nanofilter and including a microfilter fluidly disposed between said filter and said filter collection tank.

32. An electrowinning cell according to claim 30 including an electrowinning collection tank in fluid communication with said solution holding tank and said reservoir.

33. An electrowinning cell adapted to recover metal ions from a solution as their corresponding elementary metals, comprising:

(a) a reservoir adapted to receive a solution containing metal ions at a selected concentration;

(b) an anode and a cathode disposed in said reservoir, said anode and cathode operative to establish an electric potential difference therebetween;

(c) a filter in fluid communication with said reservoir and operative to receive the solution from a location proximate to said cathode, wherein said filter is operative to retain a first portion of the solution having a first concentration of metal ions and to remove a second portion of the solution having a second concentration of metal ions lower than the first concentration;

(d) return means operative to return the first portion of the solution to said reservoir; and (e) a flow-rate sensor and a valve in fluid communication with the solution, said valve having a first state allowing fluid flow and a second state preventing fluid flow, and including a microprocessor control operative to receive data from said flow-rate sensor and to adjust a flow-rate of the solution by moving said valve between the first and second states.

* * * * *